US006382386B1

(12) United States Patent
Gaponyuk et al.

(10) Patent No.: US 6,382,386 B1
(45) Date of Patent: May 7, 2002

(54) EDDY-CURRENT SENSOR FOR COIN EVALUATION

(75) Inventors: Gennadiy Gaponyuk, Toronto (CA); Vitold Khvostov, Kyiv (UA)

(73) Assignee: CashCode Company Inc., Concord (CA)

( * ) Notice: Subject to any disclaimer, the term of this patent is extended or adjusted under 35 U.S.C. 154(b) by 0 days.

(21) Appl. No.: 09/575,448

(22) Filed: May 22, 2000

(51) Int. Cl.[7] ..... G07D 5/08
(52) U.S. Cl. ..... 194/318
(58) Field of Search ..... 194/318, 317, 194/334

(56) References Cited

U.S. PATENT DOCUMENTS 3,373,856 A * 3/1968 Kusters et al. ..... 194/100
3,390,310 A * 6/1968 Peterson ..... 317/157.5
4,875,567 A * 10/1989 Fitton ..... 194/318

* cited by examiner

*Primary Examiner*—Donald P. Walsh
*Assistant Examiner*—Mark J Beauchaine

(57) ABSTRACT

An improved eddy-current sensor for a coin validator uses a thin ferrite plate having a suitable aspect ratio for two coils. One of them serves to generate magnetic field and the other serves to produce a voltage if there is a coin with eddy-currents in it. The first coil is short cylindrical one and is placed in the middle of the biggest surface of the plate. Its axis is perpendicular to the plate surface. The second coil is wound around the plate with a half coil at one end of the plate and an opposite half coil at the opposite end of the plate, plate symmetrical about center of the plate. The sensor is positioned in the pathway of the coin validator such that the moving direction of movement of the coin is along the pathway perpendicular to the axis of the first coil and makes with the largest axis of the plate an angle about 45 degrees.

7 Claims, 2 Drawing Sheets

EDDY-CURRENT SENSOR FOR COIN EVALUATION

BACKGROUND

The present invention relates to coin validators and in particular, relates to coin validators having an eddy-current sensor for measuring of magnetic features of coins as they pass the sensor.

A primary magnetic field produces eddy-currents in the coin being evaluated and a determination of the authenticity and denomination of the coin is completed. A disturbance of the primary magnetic field caused by the eddy-currents produces a sensor signal. The eddy-currents (and so the signal) depend on such individual features of coin s its shape, specific conductivity and permeance of the material which the coin is made with. More information about the properties of the coin by using several frequencies.

With the sensor of the present invention, information is obtained as the coin moves past the sensor. The output signal of the sensor depends on the position of the coin relative to the sensors, the shape of the coin, and the shape of the primary magnetic field. To make the dependence more distinct for different positions as the coin is moving past the sensor, the magnetic field is oblate in shape.

SUMMARY OF THE INVENTION

A coin validator according to the present invention comprises a pathway for guiding a coin as it moves past any eddy-current sensor. The eddy-current sensor evaluates the shape of the coin, the specific conductivity of the coin, and permeance of the coin.

Based on these evaluations, a prediction of the coin's denomination and authenticity is made.

The sensor includes a thin rectangle ferrite plate with a primary coil and a sensing coil. The primary coil is a short cylindrical coil placed centrally on one side of the plate with the axis of the coil perpendicular to the plate's surface. This coil generates a primary magnetic field and is a field coil. The sensing coil is wound around opposite ends of the ferrite plate and has the major axis of the coil along the plate. The sensing coil is symmetrical about the middle of the plate. It produces a signal that is the sensor's response. The sensor has a plane of symmetry passing through the middle of the plate and perpendicular to the largest surface of the plate.

According to an aspect of the invention, the field coil has a cylindrical compact winding, its diameter is equal to the width of the largest surface of the ferrite plate, and the sensing coil has two symmetrical halves placed between the ends of the plate and the field coil.

According to a further aspect of the invention, setting of the sensor in the pathway is carried out in such a manner that the perpendicular to the plane of symmetry and direction of the coin moving makes an angle of about 45 degrees.

According to yet a further aspect of the invention, the guide of the pathway near the sensor is curvilinear.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 2A:
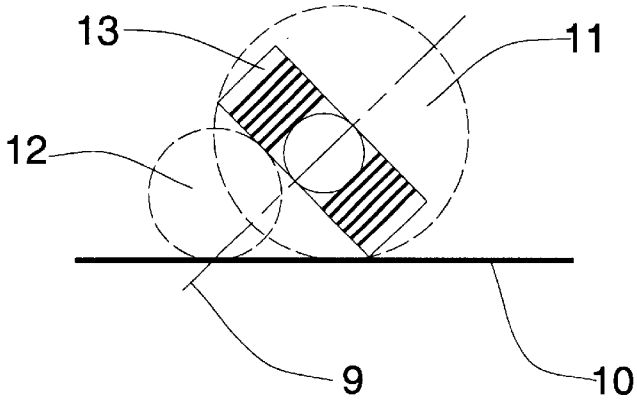
FIG. 2*a* is a front view of the sensor and pathway with FIG. 2*b* being a side view.
Figure 2B:
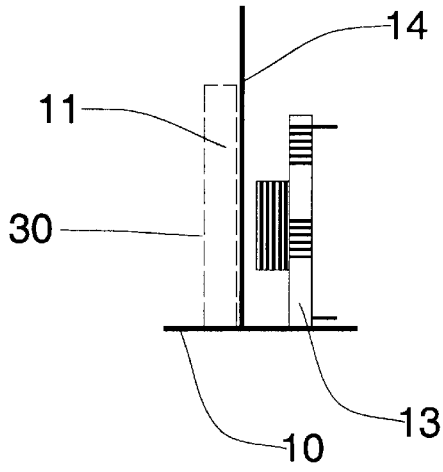

The coin validator includes a pathway 30 having a guide 10 for supporting and guiding the coin past the sensor 13. A partition 14 separates the sensor 13 from the coin. Two different diameter coins 11 and 12 are shown in FIG. 2.

Figure 1:
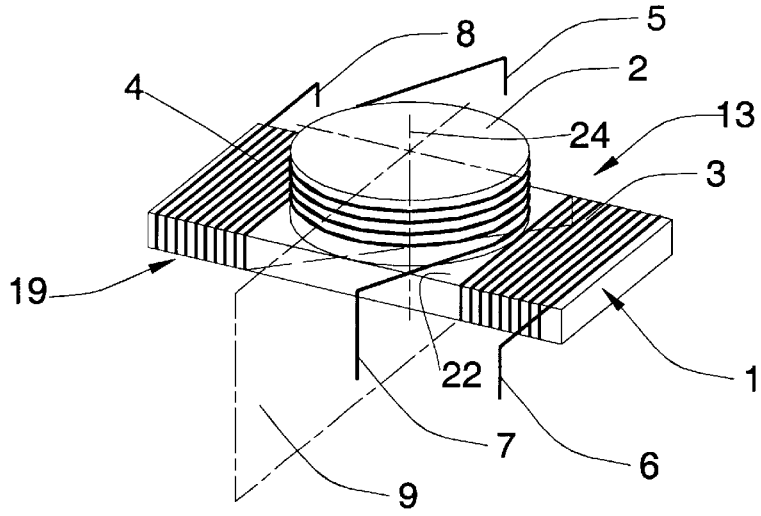
FIG. 1 is an illustrative view of the design of the sensor.

The sensor as shown in FIG. 1 includes a ferrite plate 1 supporting a field coil 2 located such that the coil axis 24 is perpendicular to the surface 22 of the plate and passes through the center of the surface. A sensing coil 19 includes two halves 3 and 4 that are wound around the ferrite plate whereby each axis of the halves 3 and 4 passes along the length of the plate. This sensing coil is wound symmetrically about the plate 1. The two half coils 3 and 4 have leads 6 and 8. Field coil 2 has leads 5 and 7.

To operate the sensor 19, the primary coil 2 is supplied with electrical current that is time-varied during the measuring time. An AC current of a certain frequency or a current of a special form is provided to the primary coil. The current creates a magnetic field around the sensor that changes according to properties of a coin as it moves past the sensor.

The time-dependent magnetic field produced by field coil 2 runs through half coils 3, and 4 and causes a voltage to be produced. Due to symmetry of the magnetic system and the location of the half coils 3 and 4 about the plane of symmetry 9, the voltage induced in the sensing coil 19 is zero (the summary voltage acting between leads 6 and 8 is zero) whereas the supply current varies.

When a coin is positioned near the sensor 13, the response of the half coils 3 and 4 are separately affected and a voltage appears. This voltage is the signal of the sensor. Therefore, the half coils 3 and 4 form the sensing coil 19. The voltage will rise and fall until the center of the coin passes through the plane 9 shown in FIG. 2a. At that time, the symmetry restores itself and a zero voltage occurs. Further movement of the coin produces a voltage opposite in polarity due to the position of the coin.

The geometry of the magnetic system including the field coil and the ferrite plate placed at the rear of the coil produces a magnetic field shape having desirable features. In the region occupied by coins during evaluation, the value of the magnetic field's tesla depends to a limited extent on the space coordinates, however, the direction is highly sensitive to the position. The power of the eddy-current depends not only on value of the primary magnetic field but also on the angle between the direction of the field and the coin's surface. This arrangement allows the sensor's signal to include more detailed information about the shape of the coin including it diameter. This information simplifies the evaluation of the coin's denomination and authenticity.

It is noted that the form of the supplying current can be chosen to accentuate the coin features being evaluated.

Determination of each of the parameters above is not required. The signal of the sensor is quite distinct simplifying evaluation of the parameters of the coin. Peculiarities of the signal—position of extremes and their values, the point where the signal becomes zero and the timing of the signal are sensitive to the coin's features. Further advantages are possible if the guide of the pathway is a special form (not linear). It allows the signal to be more significant due to guiding the coin through regions where the shape of the primary magnetic field is most suitable.

Figure 4:
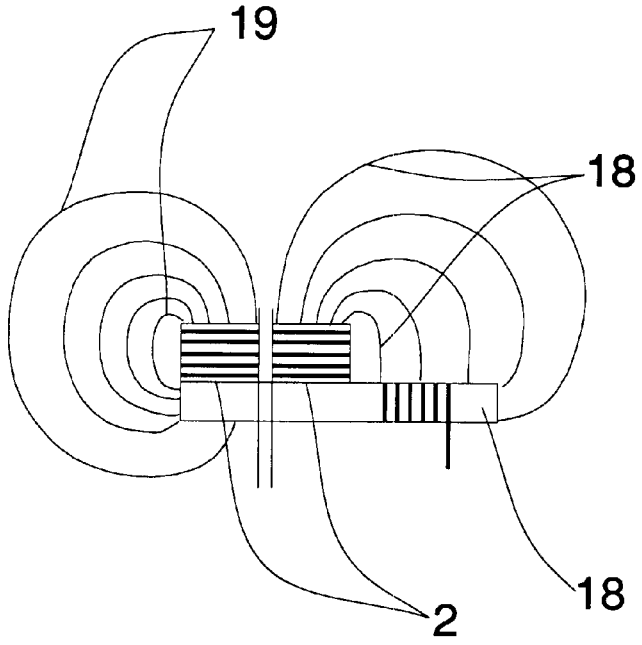
FIG. 4 is an illustrative drawing illustrating the shape of the magnetic field near the coin's guideway in two directions along and across the largest axis of the ferrite plate.

The version of the sensor showed in FIG. 1 is liable to be influenced by extraneous magnetic fields. If there is a need of protecting the signal from extraneous magnetic fields, a more complex version of the sensor can be used as shown in FIG. 4. This sensor 113 contains two equal ferrite plates (main 100 and additional 115) and two identical sensing coils 120 and 130 where each coil has two half coils 122, 124 and 132, 134 respectively connected in such a manner that the voltages induced in them by an extraneous magnetic field balance each other. The plates are separated by a short distance. The voltages produced with coin disturbance are not fully balanced because of the shielding of the additional parts by the basic ferrite plate. This design diminishes the influence of extraneous magnetic fields if they are significant and if the frequency ranges of the signal and these fields overlap.

The advantages of the sensor are based on the following principle.

As it is known, the power, being dissipated in the conducting body due to the eddy-currents caused by alternating magnetic field in it, depends not only on magnetic energy located in the body but also on the shape of both the body and the magnetic field. The dependence has an integral behavior. With this arrangement, more precise information about the shape of the body can be obtained by evaluating how the integral eddy-current characteristics vary with variation in the shape of the primary magnetic field.

The spatial distribution of the disturbance of primary magnetic field caused by eddy-currents is also shape-dependent. The reaction of the sensitive coil to the disturbance is conditioned by several geometric factors. The sensor signal represents these geometrical relations as the coin moves past the sensor.

FIG. 4 illustrates the special shape of the primary magnetic field and a special location of the sensing coil. The narrow ferrite plate is locate with the longest axis perpendicular to the axis of the field coil to produce the oblete in shape primary magnetic field- Lines of force of the field are prolate enough along the longest axis of the ferrite plate (see 18) and are not so prolate along its middle axis (see 19). Therefore, as a coin moves past the sensor, there are points where line-of-force's projection going along the biggest surface of the coin dominates and there are points where the projection going perpendicular to this surface dominates. There are also points where the sensing coil senses the component of magnetic field caused by eddy-currents, which goes along the coin's surface, better than the one perpendicular to the coin surface and there are points where a reverse ratio takes place.

Depending on the coin dimension, the time-the coin traverses the symmetry plane 9 varies (see FIG. 2). Small coins, like 12, traverse it before they come to the centre of the sensor, large coins 13 traverse it after that. Therefore, the moment when the signal is zero is dependent on the coin's size and this moment is an indication of the coin's diameter. When a coin first approaches the sensor, the signal rises and subsequently the signal falls until the coin traverses the symmetry plane 9. The signal then rises but its polarity is opposite. The signal caused by the coin up to the point traversing the symmetry plane and the signal after passing the symmetry are only similar in the case where the coin is of a diameter that the centre of the coin passes through the centre of the sensor. In the other cases, the signals are not equivalent. Details of deviation of the signal from a symmetrical signal also provides valuable coin information.

According to aforesaid, the sensor signal has several quantitative rates to evaluate a coin's denomination and authenticity. For instance, value and position of the first extreme of the signal (maximum) position of the next zero level and value and position of the second extreme. Each of them is formed by union of coin's parameters—shape, specific conductivity and magnetic properties and of primary magnetic field parameters—shape and intensity. For various coin types, combinations of these variables change as the coin moves past the sensor. This makes the task of coin identification and authenticity simpler.

Figure 3:
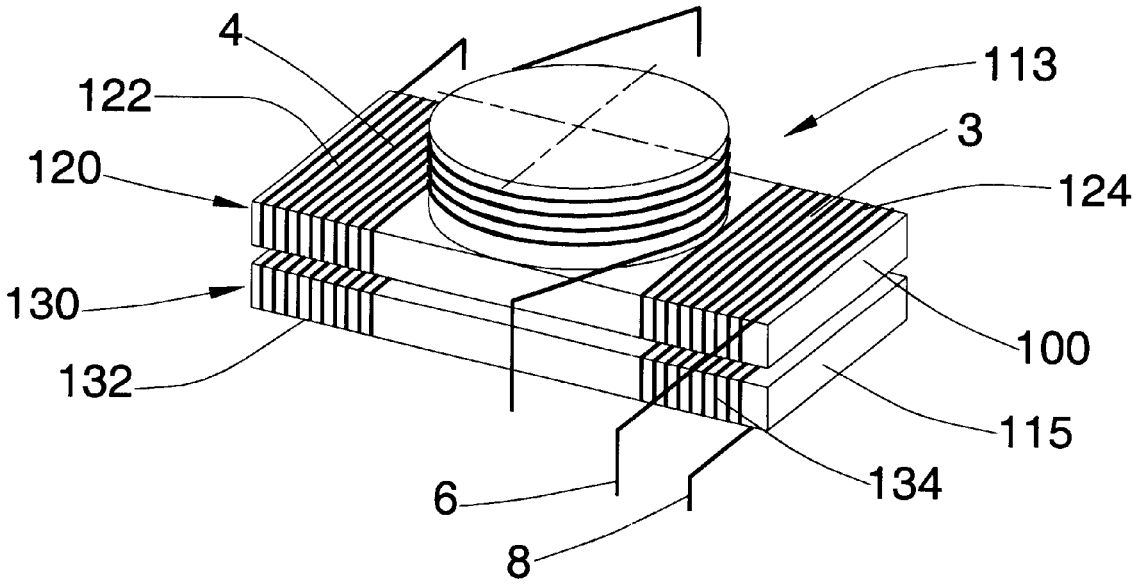
FIG. 3 is a perspective view of an alternative version of the sensor.

Besides, it is important that the accuracy of the sensor primarily depends on geometrical factors because the magnetic features of the ferrite plate do not affect the primary magnetic field in a wide range of these features. The magnetic system of the sensor is "wide opens" and the magnetic resistance of the plate is less than the magnetic field, there may be some difficulties because a "wide open" magnetic system has appreciable sensitivity to such fields. To diminish this effect, a compensation of the field influence may be performed with using another ferrite plate and another sensitive coil as it is shown on FIG. 3. Here the second ferrite plate 115 is positioned behind the first plate 100. The second plate has a sensitive coil 130 being identical to one belong to the first plate (122,124). Both the coils (122, 124 and 132, 134) are connected in series in such a manner that the voltages induced in the coils by the extraneous magnetic field suppress each other. Because sources of the extraneous magnetic fields are usually situated far enough from sensor, their influence on both the sensitive coils is equal. Therefore, suppression is effective. As to the main signal, the voltages induced, as a coin, is close to the sensor, are different from each other. This is a result of shielding of the primary magnetic field with the first plate due to high permeance of the plate material and due to non-magnetic gap between the plates.

The guide of the pathway 10 is designed for the coin to follow a particular path. This path can be linear or not linear, horizontal or vertical, and so on, depending on the applications. The coin position as it moves past the sensor, is to be predetermined to avoiding change in the sensor state due to varying of the position of the coin in the pathway. The best design of the pathway is such that dependence of the position on time is steady. This allows processing the sensor signal as a time dependent signal.

Although various preferred embodiments of the present invention have been described herein in detail, it will be appreciated by those skilled in the art, that variations may be made thereto without departing from the spirit of the invention or the scope of the appended claims.

The embodiments the invention in which an exclusive property or privilege is claimed are defined as follows:

1. A coin validator comprising a pathway for moving a coin along a predetermined path, an eddy-current sensor positioned along said path for evaluating geometrical and magnetic features of the coin; said eddy-current sensor comprising a ferrite plate and a primary coil and a sensing coil, said primary coil having a short cylindrical winding and said sensing coil being wound around said ferrite plate structure with an axis of the primary coil perpendicular to a flat surface of said ferrite plate, said sensing coil being symmetrically located about a middle of the ferrite plate with an axis of the sensing coil extending in the length of said ferrite plate; and wherein the sensor is positioned along the pathway such that the angle of the direction of a coin moving along the pathway forms an angle of about 45 degrees with a major axis of said sensor.

2. A validator as claimed in claim 1 wherein said sensing coil consists of two halves located symmetrically about the middle of said ferrite plate.

3. A validator as claimed in claim 1 having a curvilinear guide of the pathway to direct coins on the trajectory that allows the signal to be more significant.

4. A coin validator comprising a pathway for moving a coin along a predetermined path, an eddy-current sensor positioned along said path for evaluating geometrical and magnetic features of the coin; said eddy-current sensor comprising a first and second ferrite plates disposed in overlapping parallel relationship, a primary coil, a sensing coil, and a compensating coil connected in series with said sensing coil; said primary coil having a short cylindrical winding and said sensing coil being wound around said first ferrite plate structure with an axis of the primary coil perpendicular to a flat surface of said first ferrite plate and a flat surface of said second ferrite plate, said sensing coil being symmetrically located about a middle of the first ferrite plate with an axis of the sensing coil extending in the length of said first ferrite plate; said second ferrite plate being equal in size and aligned with said first ferrite plate with said compensating coil wound symmetrically about a middle of said second ferrite plate such that voltages induced in said coils by extraneous magnetic fields are opposite in sign and wherein the sensor is positioned along the pathway such that the angle of the direction of a coin moving along the pathway forms an angle of about 45 degrees with a major axis of said sensor.

5. A validator as claimed in claim 4 wherein said sensing coil comprises two halves located symmetrically about the middle of said first ferrite plate.

6. A validator as claimed in claim 5 wherein said compensating coil comprises two halves located symmetrically about the middle of said second ferrite plate.

7. A validator as claimed in claim 7 wherein said primary coil is located centrally in a length of said first ferrite plate.

* * * * *